US005191360A

United States Patent [19]

Pohlig

[11] Patent Number: 5,191,360

[45] Date of Patent: Mar. 2, 1993

[54] HEATING DEVICE FOR HEATING THE INK IN THE PRINTING HEAD OF AN INK JET PRINTER

[75] Inventor: Dietmar Pohlig, München, Fed. Rep. of Germany

[73] Assignee: Mannesmann Aktiengesellschaft, Düsseldorf, Fed. Rep. of Germany

[21] Appl. No.: 715,782

[22] Filed: Jun. 14, 1991

[30] Foreign Application Priority Data

Dec. 14, 1988 [EP] European Pat. Off. ..... 88120856.5

[51] Int. Cl.[5] ..... B41J 2/05

[52] U.S. Cl. ..... 346/140 R

[58] Field of Search ..... 346/140 R

[56] References Cited

U.S. PATENT DOCUMENTS

| | | | |
|---|---|---|---|
| 4,719,472 | 1/1988 | Arakawa | 346/140 R |
| 4,899,180 | 2/1990 | Elhatem | 346/140 R |
| 4,910,528 | 3/1990 | Firl | 346/140 R X |
| 5,095,321 | 3/1992 | Saito | 346/140 R X |

*Primary Examiner*—Joseph W. Hartary

*Attorney, Agent, or Firm*—Horst M. Kasper

[57] ABSTRACT

A heating device for heating of ink in a print head of an ink print device comprises several ink channels ending in exit openings (10). The ink channels (8) are connected to a joint ink volume space (9), with individually controllable electrothermal converter elements (3) coordinated to each separate ink channel (8), where under the effect of the converter elements (3) a droplet-wise ejection of ink occurs from the exit openings (10). The print head is constructed in a layer structure. A further cover layer (14) is applied onto the uppermost cover layer (2, 3, 4, 5, 6) of a substrate (1), delimiting the ink volume space (9) and the ink channels (8) and containing the electrothermal converter elements (3) where the further cover layer (14) serves both as a heating layer for heating the ink and as a temperature sensor layer for determinating the temperature of the ink. The cover layer (14) is contactable from the outside and is covered by a further protective layer (13). The cover layer (14) is extending over a large area of the region of the ink volume space (9).

9 Claims, 3 Drawing Sheets

HEATING DEVICE FOR HEATING THE INK IN THE PRINTING HEAD OF AN INK JET PRINTER

CROSS-REFERENCE TO RELATED APPLICATIONS

This application is a continuation-in-part application of another international application filed under the Patent Cooperation Treaty Nov. 30, 1989, bearing Application No. PCT/EP89/01452, and listing the United States as a designated and/or elected country. The entire disclosure of this latter application, including the drawings thereof, is hereby incorporated in this application as if fully set forth herein.

BACKGROUND OF THE INVENTION

1. Field of the Invention

The invention relates to a heating device for heating the ink in the printing head of an ink jet printer with several ink channels ending in exit openings, where the ink channels are connected to a joint ink volume space, and with individually controllable electrothermal converter elements coordinated to each ink channel, where the converter elements effect a droplet-wise ejection of ink from the exit openings.

2. Brief Description of the Background of the Invention Including Prior Art

A known principle for generation of characters on a recording substrate is based on the ejection of individual ink droplets, under the effect of a control, from the nozzles of a print head, where the print head is part of an ink printing device. By tuning and adjustment between the ejection of individual droplets and the relative motion between the recording substrate and the print head there are thereby generated characters and/or graphic patterns on the recording substrate like a grid. The operational safety and the quality of the recordings depend to a large extent on the uniformity of the ejection of the droplet. This means that the individual droplets, ejected by a control pulse have to exhibit a defined size and they have to leave the nozzle of the print head in every case at the same speed. The influence of the viscosity of the ink is very substantial for a uniform droplet ejection. The viscosity of the ink depends to a large extent on the temperature. Therefore, it is already known to maintain the temperature of the ink in an ink print head at a constant value. It is further known to furnish a heating element in the nozzle plate, according to the German Printed Patent Document Laid Open DE-OS 2,659,398 for a print head, where the individual ink channels are furnished, which ink channels end at the exit nozzles of a nozzle plate. It is further known to furnish for such print heads an induction coil in the area of the nozzle plate and to heat the nozzle plate by eddy currents and hysteresis losses as taught in the German Printed Patent Document Laid Open DE-OS 3,500,820.

More recently it has become known to achieve the ejection of individual ink droplets by generating an ink vapor bubble in the region of an electrothermal energy converter disposed in the ink channel. The ink vapor bubble defines a certain ink volume which is ejected as a droplet out of the ink channel. Such a print head can be constructed according to a thin layer technology. The temperature dependence on the viscosity of the ink is a very substantial factor for print heads of this kind. Therefore, it is further known for such print heads to improve the ejection coefficient by heating of the ink.

This heating of ink can be provided by additional heating elements furnished for acting from the outside onto the ink, as taught, for example, in the German Printed Patent Documents Laid Open DE-OS 2,943,164 and DE-OS 3,545,689. Positive temperature coefficient resistors are frequently used for such heating elements. The temperature of the ink in the print head can be brought to and maintained at a certain value in connection with a control and a temperature sensor element. Frequently, a negative temperature coefficient resistor is employed as a temperature sensor element However, there result typically long heat-up times, in particular in connection with a print head with electrothermal converters. The reason for the relatively long heat-up times is based on that means for cooling have to be provided for print heads with electrothermal converters because of the heating of the ink occurring during continuous printing operation. For this purpose, the print head is usually disposed on a cooling surface, for example, on an aluminum plate. If, the ink has to be heated up after longer intervals of rest or non-use of the machine or of the printer, or upon switching on of the ink print device, then the cooling face has always to be heated at the same time. Relatively long heat-up times result by this process. In addition, the expenditure as far as the construction and production technology is concerned is not unsubstantial, since in each case additional individual elements have to be maintained ready, have to be mounted, and have to be electrically connected.

It is in fact already known from the German Printed Patent Document Laid Open DE-OS 2,943,164 either to dispose a heating coil in the interior of the ink volume space (direct heating) or to dispose a heating coil also in the ink volume space where however a coating or covering of the heating coil is to be provided (indirect heating). In the first case, in addition to the constructive expenditure, such as for example large-volume disposition, additional problems can arise in that the ink fluid reacts chemically at the heating surface which can cause deposits.

A further possible embodiment according to this reference comprises that the electrothermal converters are covered with a preheating device by the addition of a layer and include a temperature control device. This allows to react to changes in the ambient conditions.

SUMMARY OF THE INVENTION

1. Purposes of the Invention

It is an object of the invention to furnish a device for the heating and heating up, respectively, of the ink for print heads in ink print devices, whereby the heat-up time is reduced.

It is another object of the present invention to provide a reliable thermal control of the ink temperature in an ink jet printer with small automatic control set point deviations.

It is yet another object of the present invention to furnish an ink jet print head requiring a small space for heating purposes and, if necessary, for sensor elements which can be produced with low production expenditures and which can be easily assembled.

These and other objects and advantages of the present invention will become evident from the description which follows.

2. Brief Description of the Invention

According to the present invention there is provided a heating device for heating of ink in a print head of an ink print device with several ink channels ending in exit openings. The ink channels are connected to a joint ink volume space with individually controllable electrothermal converter elements coordinated to each separate ink channel. Under the effect of the converter elements a droplet-wise ejection of ink occurs from the exit openings. The print head is constructed in a layer structure. A further cover layer is applied onto the uppermost cover layer of a substrate, delimiting the ink volume space and the ink channels and containing the electrothermal converter elements. The further cover layer serves both as a heating layer for heating the ink and as a temperature sensor layer for determinating the temperature of the ink. The cover layer is contactable from the outside and is covered by a further protective layer. The cover layer is extending over a large area of the region of the ink volume space.

The cover layer can be constructed like a meander. The cover layer can be made of a material, where its resistance value has a large temperature dependence. The cover layer is effective as a temperature sensor during interruption intervals free from heating current.

The advantages of the construction according to the invention include that the heating and sensor element can be integrated in the structure of the print head. The integration into the thin-layer structure allows the production of the complete print head in a single technology. This eliminates the keeping at ready and the assembly of separate heating and sensor elements as well as the additional soldering processes for the connection lines of individual device components. Since heating elements and, if required, sensor elements are disposed in the immediate proximity of the ink, and since the heating does not primarily heat the complete carrier but heats immediately the ink, there result the short heat up times. Additional advantages associated with the invention construction include that the cooling face of the print head can be desired to be enlarged without simultaneously increasing the heating capacity for the ink heating.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
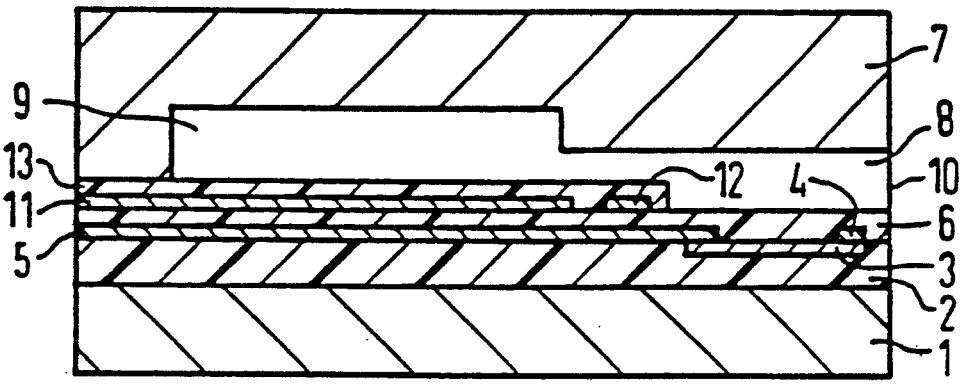
FIG. 1 illustrates a first embodiment where a heating element and a sensor element are provided.

A resistive layer acting as an electrothermal converter element 3, as well as contacts 4 and 5 for this resistive layer, are placed onto a substrate 1 as a carrier between a first cover layer 2 and a second cover layer 6. Preferably, the substrate 1 is made of silicon, the cover layers 2 and 6 of silicon oxide ($SiO_2$), the converter element 3 of hafnium boride ($HfB_2$) and the contacts 4 and 5 are made of aluminum (Al). The construction is finished on the top by a cover plate 7 such that a series of ink channels 8 and a joint ink volume space 9 is formed between the uppermost cover layer 6 and the cover plate 7. In each case, an ink channel 8 is coordinated to an exit opening 10 of the print head. The ink volume space 9, jointly provided for all ink channels 8, is connected to an ink supply, not illustrated in the drawings. In each case, a converter element 3 is coordinated to one respective ink channel 8.

For the ejection of an ink droplet, current is supplied to the converter element 3 via the connections of the contacts 4 and 5. In case of a multinozzle print head, the connection of the contact 5 for each individual converter element 3 is individually furnished, and the connection for the contact 4 is provided Jointly for several or also all converter elements. An immediate heating of the converter element 3 is associated with the individual control of a converter element, where the heating results in the formation of an ink vapor bubble in the ink channel 8. A defined ink volume is displaced thereby both towards the ink volume space 9 as well as in the direction of the exit opening 10 and is ejected at the exit opening 10 as an individual droplet.

A heating element and a sensor element, provided as a further thin-film layer as uppermost layer on the substrate 1 and thus in closest possible proximity of the ink in the ink volume space 9 is furnished for the heating of the ink to a value, where the viscosity of the ink is optimal for the ejection process. This further thin-film layer is structured such that it forms a heating layer 11 and a sensor layer 12. In order to avoid effects of the ink fluid onto the material properties of the heating layer 11 and the sensor layer 12 it is advantageous to furnish an electrically insulating protective layer 13 above the heating layer 11 and above the sensor layer 12. This assures at the same time that electrically conducting ink fluids can also be employed. The protective layer 13 can, for example, be made of a polyamide. Pure metals, alloys and possibly also doped silicon can be considered as suitable materials for the heating layer 11. Advantageously, permalloy, which exhibits a temperature coefficient for the electrical resistivity in the order of magnitude of $38 \cdot 10^{-3}$ for each degree Kelvin, is suitable as a material for the sensor layer. However, other materials with temperature coefficients of similar magnitude are also possible for the production of this sensing element. The heating layer 11 is disposed over an area size as large as possible and preferably extending over the complete region of the ink volume space 9. The heating layer is advantageously structured like a meander. This achieves a sufficiently large electrical resistance tuned and adapted to the voltage supply. For example, the resistance value can amount to 180 ohms for a heating capacity of 5 watts with an applied voltage of 30 volts.

Figure 2:
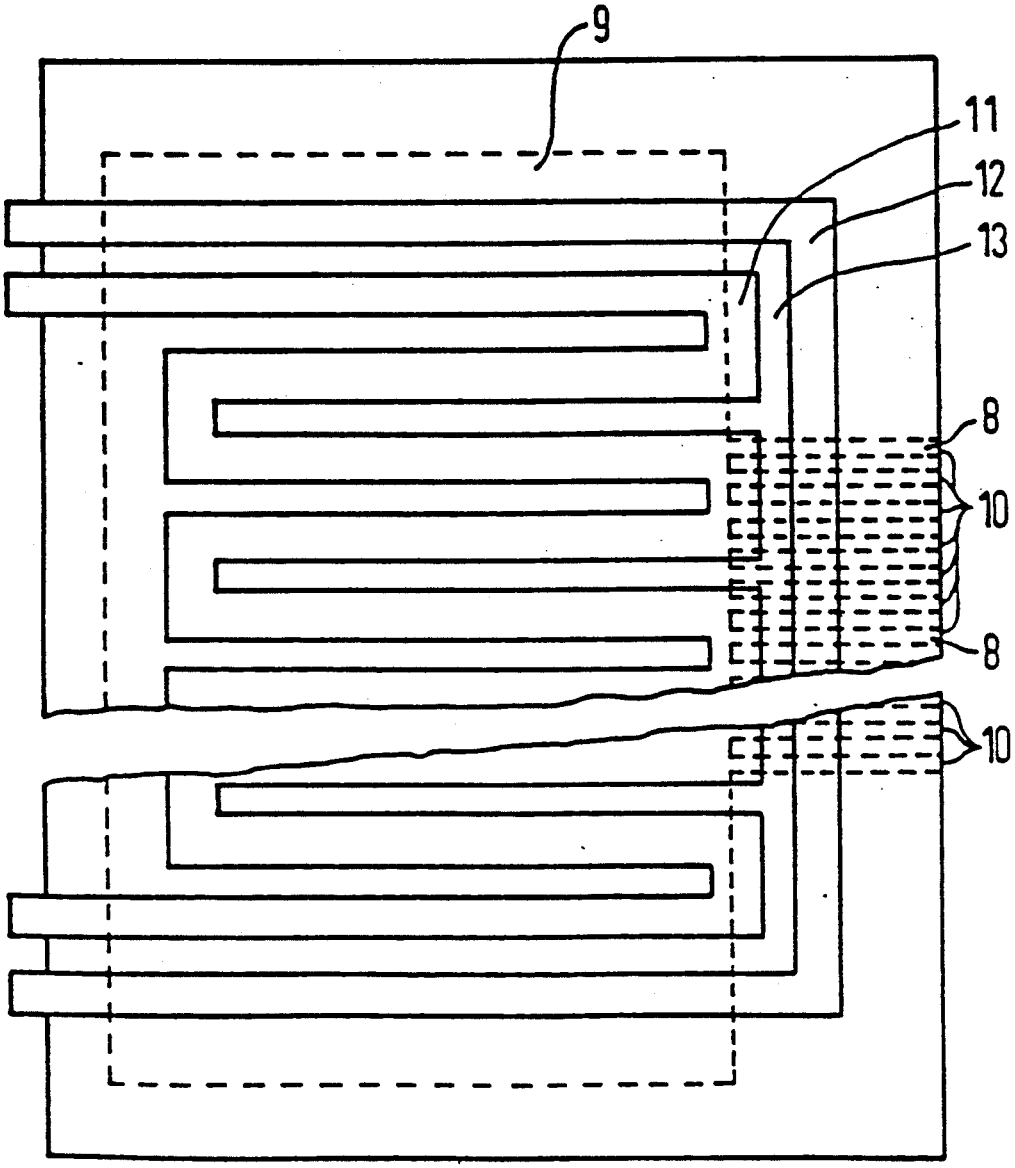
FIG. 2 is a schematic top-plan view of the heating element of FIG. 1.

An example for the meander-shaped structure of the heating layer 11 as well as for the disposition of the sensor layer 12 is illustrated in FIG. 2. It can be recognized that the heating layer 11 extends uniformly over the complete region of the ink volume space 9. This assures a very quick and rapid heat transfer to the ink. The sensor layer 12 captures in this example the ink temperature both in the ink volume space 9 as well as in the region of the ink channels 8.

According to an embodiment of the invention it is possible to furnish an active sensor region in each case only in the region of the ink channels 8. While a temperature average value is taken according to the embodiment illustrated in FIGS. 1 and 2, this embodiment captures only the temperature of the ink in the area of the ink channels 8 with this structure. In this case, it is advantageous to employ a material for the contacting of the sensor layer 12 having temperature-independent resistance value.

Figure 3:
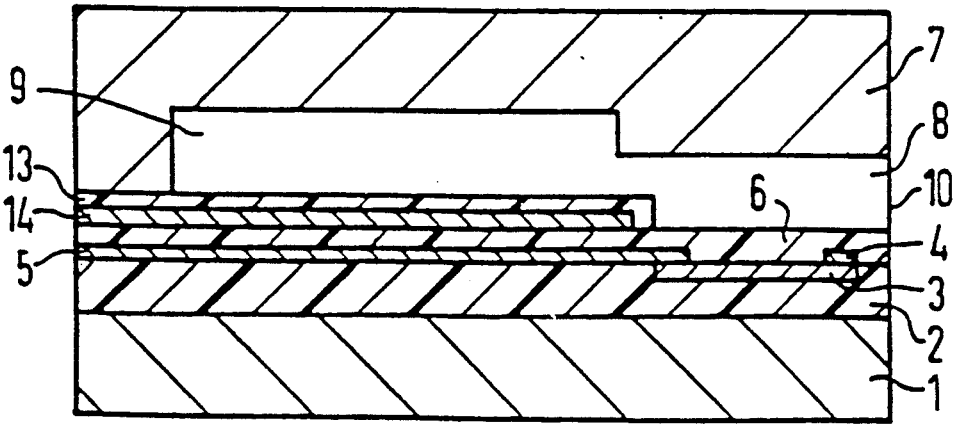
FIG. 3 is a sectional elevational view of a second embodiment, where the heating element furnishes simultaneously a sensor element.
Figure 4:
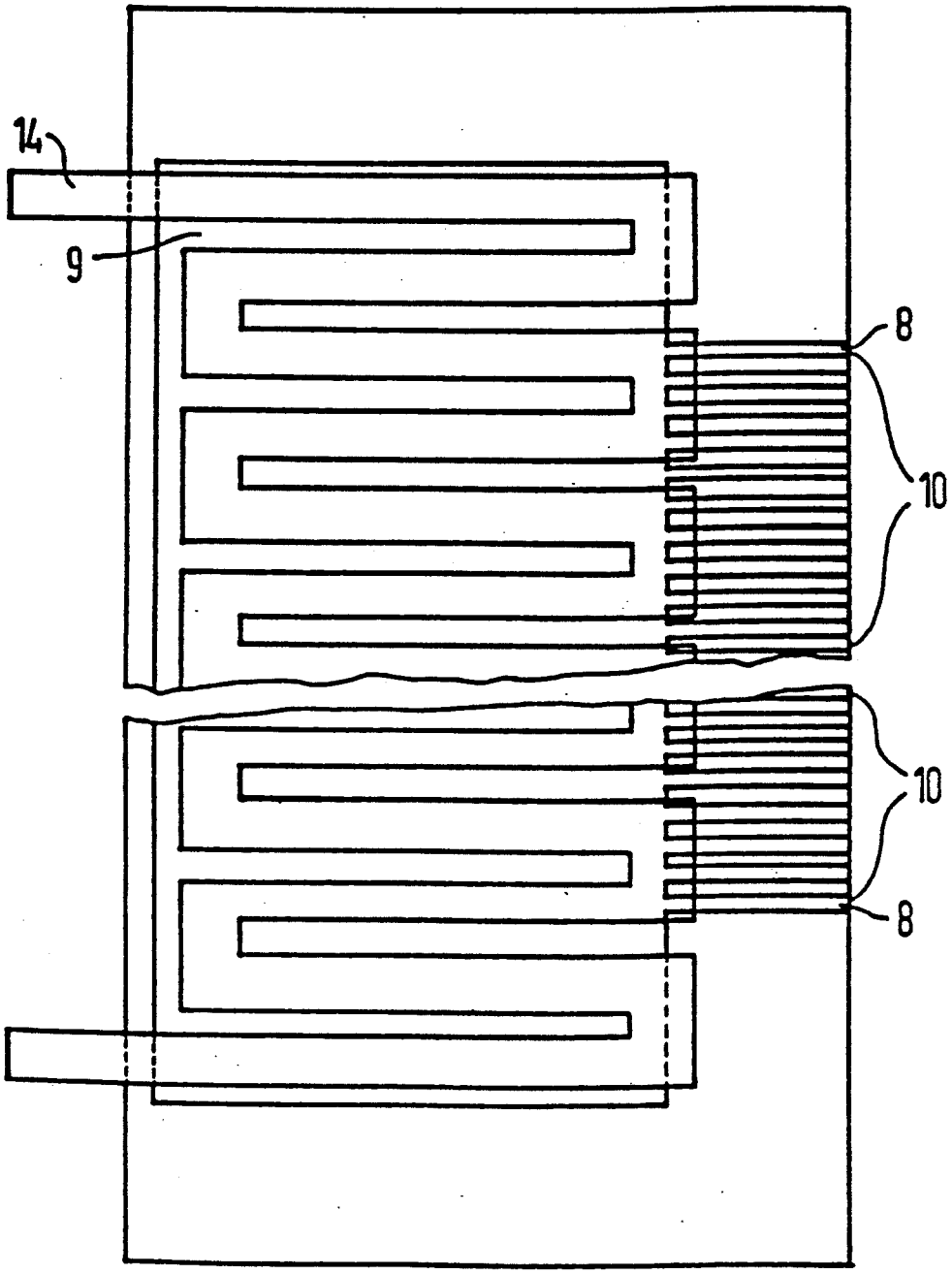
FIG. 4 is a schematic top-plan view of the embodiments of FIG. 3.

According to a further embodiment of the invention, a material with a large temperature dependence of its resistance value is employed for the heating layer. For example, nickel or nickel alloys can be considered in this context. It is important that such alloys can be positive in cover layers. This is associated with the advantage that the heating layer formed in this manner can serve simultaneously both as a heating element and as a sensor element. The layer structure of the print head, where the heating and the sensor layer are made by one single thin-film layer, is illustrated in FIG. 3. The disposition of the heating layer and of the sensor layer in the form of a meander-shaped structure is illustrated in FIG. 4. The layer structure comprises the substrate 1, where the cover layer 2, the electrothermal converter element 3, the contacts 4 and 5, as well as the second cover layer 6, are disposed on the substrate 1. The heating and sensor layer 14 is applied as a further thin-film layer onto the cover layer 6 and the heating and sensor layer 14 is covered by a protective layer 13. The heating and sensor layer 14 extends in the examples of FIGS. 3 and 4 over the complete ink volume space 9 up into the individual ink channels 8. The heating and sensor layer 14 is structured like a meander and can be seen by way of example in FIG. 4.

This embodiment is associated with the advantage that the same complete layer can be employed as a temperature sensor because of the large temperature dependence of the electrical resistivity of a heating layer, formed of nickel, during the current interruption intervals for pausing the heating. According to such a constructive concept, not only does an additional sensor device element become unnecessary, but there are also eliminated the electrical feed lines for such an additional sensor element.

It will be understood that each of the elements described above, or two or more together, may also find a useful application in other types of heating devices for printing heads differing from the types described above.

While the invention has been illustrated and described as embodied in the context of a heating device for heating the ink in the printing head of an ink jet printer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A heating device for heating of ink in a print head of an ink print device comprising a joint ink volume space;

several ink channels ending in exit openings (10), where the ink channels (8) are connected to the joint ink volume space (9);

individually controllable electrothermal converter elements (3) coordinated to each separate ink channel (8), where under the effect of the converter elements (3) a droplet-wise ejection of ink occurs from the exit openings (10);

a substrate;

an uppermost cover layer (2,3,4,5,6) disposed on the substrate;

a further cover layer (14), wherein the print head is constructed in a layer structure, wherein the further cover layer (14) is applied onto the uppermost cover layer (2, 3, 4, 5, 6) of a substrate (1), delimiting the ink volume space (9) and the ink channels (8) and containing the electrothermal converter elements (3) wherein the further cover layer (14) serves both as a heating layer for heating the ink and as a temperature sensor layer for determinating the temperature of the ink, wherein the further cover layer (14) is contactable from the outside; and a further protective layer, wherein the further cover layer is covered by the further protective layer (13), and wherein the further cover layer (14) is extending over a large area of the region of the ink volume space (9).

2. The heating device according to claim 1, wherein the further cover layer (14) is structured like a meander.

3. The heating device according to claim 1, wherein the further cover layer (14) is made of a material, where the resistance value of the material of the further layer has a large temperature dependence, and wherein the cover layer (14) is effective as a temperature sensor during interruption intervals free from heating current.

4. A print head of an ink print device comprising a print head constructed from a substrate formed of a layer structure having an uppermost and a lowermost layer and wherein the uppermost layer is adjoining the lowermost layer;

a cover layer applied onto the uppermost layer of the substrate;

an ink volume space delimited by the cover layer, wherein the cover layer extends over a large area of a region of the ink volume space;

a plurality of ink channels ending in respective discharge openings and connected to the joint ink volume space, wherein the cover layer applied onto the uppermost layer of the substrate delimits the ink channels;

a plurality of individually controllable electrothermal converter elements formed in the cover layer, wherein each individually controllable converter element is associated to one respective separate ink channel, wherein the converter elements are capable of effecting a droplet-wise ejection of ink occurs from the discharge openings, wherein the cover layer serves both as a heating layer for heating the ink and as a temperature sensor layer for determining the temperature of the ink, wherein the cover layer is contactable from the outside;

a protective layer covering the cover layer.

5. The print head according to claim 4, wherein the cover layer is structured like a meander.

6. The print head according to claim 4, wherein the cover layer includes a material having a resistance value with a large temperature dependence, and wherein the cover layer operates as a temperature sensor during interruption time intervals without application of a heating current to the cover layer.

7. A heating device for heating of ink in a print head of an ink print device comprising a circuit board formed of a protective layer;

a cover layer disposed adjoining and below the protective layer, wherein the protective layer covers the cover layer, wherein individually controllable electrothermal converter elements are disposed in the cover layer and wherein the cover layer delimits an ink volume space, wherein the cover layer is extending over a large area of the ink volume space, wherein the cover layer serves both as a heating layer for heating ink and as a temperature sensor layer for determining a temperature of the ink, and wherein the cover layer is contactable from the outside;

a layer structure having an uppermost layer adjoining and disposed below the cover layer and covered by the cover layer, wherein a plurality of ink channels ending in discharge openings are disposed in the layer structure, wherein the ink channels are connected to a joint ink volume space disposed in the layer structure, wherein the individually controllable electrothermal converter elements disposed in the cover structure are coordinated one to one to each ink channel, wherein the converter elements are capable of effecting droplet-wise ejection of the ink from the discharge openings.

8. The heating device according to claim 7, wherein the cover layer is structured like a meander.

9. The heating device according to claim 7, wherein the cover layer includes a material, wherein the material has a resistance value with a large temperature dependence, and wherein the cover layer serves as a temperature sensor during time intervals where a heating current is interrupted.

* * * * *